US006694936B2

(12) United States Patent
Stallmann

(10) Patent No.: US 6,694,936 B2
(45) Date of Patent: Feb. 24, 2004

(54) ROCKER ARM ARRANGEMENT FOR INTERNAL COMBUSTION ENGINE

(75) Inventor: John Stallmann, Washington, MI (US)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/183,940

(22) Filed: Jun. 26, 2002

(65) Prior Publication Data

US 2003/0140878 A1 Jul. 31, 2003

Related U.S. Application Data

(60) Provisional application No. 60/353,684, filed on Jan. 31, 2002.

(51) Int. Cl.[7] ..... F01L 1/18

(52) U.S. Cl. ..... 123/90.41; 123/90.42; 123/90.44

(58) Field of Search ..... 123/90.39, 90.41, 123/90.42, 90.4, 90.43, 90.44, 90.45, 90.46, 90.47

(56) References Cited

U.S. PATENT DOCUMENTS

| | | | | | |
|---|---|---|---|---|---|
| 3,198,183 | A | * | 8/1965 | Ball | 123/90.42 |
| 5,074,261 | A | * | 12/1991 | Hamburg et al. | 123/90.39 |
| 5,720,245 | A | * | 2/1998 | Calka | 123/90.41 |
| 6,334,416 | B2 | * | 1/2002 | Okubo et al. | 123/90.42 |

* cited by examiner

*Primary Examiner*—Thomas Denion
*Assistant Examiner*—Jaime Corrigan
(74) *Attorney, Agent, or Firm*—Volpe and Koenig, P.C.

(57) ABSTRACT

A rocker arm (1) for a valve train of an internal combustion engine which is pivoted on a support pin (10) about its axis (9), whereby a push rod (7) contacts one end section (5), and the valve shaft (8) of a gas exchange valve contacts the other end section (6). The mounting of the rocker arm (1) on the support pin (10) takes place through two radial roller bearings (16) spaced at a distance from each other, whereby in a manner in accordance with the invention, an additional axial roller bearing (17, 18) is incorporated into the rocker arm bearing arrangement to prevent sliding friction.

7 Claims, 3 Drawing Sheets

ROCKER ARM ARRANGEMENT FOR INTERNAL COMBUSTION ENGINE

CROSS-REFERENCE TO RELATED APPLICATIONS

This application claims the benefit of U.S. Provisional Application No. 60/353,684, filed Jan. 31, 2002.

BACKGROUND

The present invention relates to a rocker arm for a valve train of an internal combustion engine which is pivoted on a bearing arrangement on a support pin (also known as a trunnion), whereby the support pin is connected with a cylinder head through a support block. The rocker arm is formed from a U-shaped metal element with at least two side walls that extend parallel to one another in the region of the support pin, which have aligned holes which each accommodate one radial roller bearing. In any case, an outer bearing ring of the radial roller bearing is arranged in each of the bore holes. The side walls are connected through an upper or a lower wall, so that a push rod contacts one end section of the rocker arm and a valve shaft of a gas exchange valve contacts the opposite end section.

Rocker arm arrangements of this type for controlling a valve train of internal combustion engines have been previously known for a long time. Such an arrangement is, for example, described in DE-OS 20 38 381. A U-shaped rocker arm open upwardly has two side walls which are connected with each other through a lower wall. This operating lever is pivoted on a support pin which once again is connected through a support block with the cylinder head of the internal combustion engine. A cam-actuated push rod contacts one end region of the rocker arm, and a valve shaft of a gas exchange valve contacts the other opposite end region. If now the push rod moves upward, the rocker arm swivels about its pivot axis so that its other end region is moved downward, so that the gas exchange valve is brought into the open position. The mounting of the rocker arm on the support pin takes place such that the rocker arm is held on both sides of the support block in needle bearings, the bearing outer ring of each of which is pressed into a through hole in the side wall in question.

Here it is disadvantageous that oblique angles of the push rod, caused by construction conditions, create axial forces. These axial forces lead to a sliding contact between rocker arm and its support arrangement or between the rolling elements and the end flanges within the radial roller bearing. This sliding contact unnecessarily increases friction, and therewith generates heat.

SUMMARY

It is therefore the object of the invention to configure a bearing arrangement of a rocker arm for a valve train of an internal combustion engine such that the latter can accommodate axial forces without difficulty, in addition to the radial forces that arise.

This object is accomplished in accordance with the invention by providing a rocker arm which is pivotably connected by a bearing arrangement on a support pin, whereby the support pin is connected with a cylinder head through a support block. The rocker arm is formed as a U-shaped metal element with at least two side walls that extend parallel to one another in the region of the support pin which have aligned holes for each accommodating a radial roller bearing. An outer bearing ring of each of the radial roller bearings is arranged in the holes. The side walls are connected with each other through at least one of an upper and a lower wall so that a valve shaft of a gas exchange valve contacts one end section. An axial roller bearing is arranged at least in connection with one of the radial roller bearings.

This additional axial roller bearing replaces sliding friction arising in connection with an inclined position of the push rod with rolling friction and thus diminishes the overall amount of friction. This diminution of the overall amount of friction once again contributes to extending the life of the rocker arm arrangement.

Further advantageous developments of the rocker arm arrangement of the invention are described below.

In one aspect of the invention, the axial roller bearing is arranged internally or externally in connection with the radial roller bearing. The arrangement of the additional axial roller bearing is oriented according to the axial forces and overturning moments arising in any given case.

In another aspect, the radial roller bearing comprise two formed bearing rings manufactured by a chipless process which have at each opposite-lying end a radially inwardly directed rim and a radially outwardly directed rim. The axial roller bearing should include two thrust washers between which rolling elements located in a cage roll pass, whereby one thrust washer is braced on the radially inwardly directed rim and the other thrust washer is braced on a shoulder of the support pin. The radial inwardly directed rim of the outer ring and the shoulder of the support pin may also serve as the thrust surfaces for the axial rollers if properly prepared.

A particularly advantageous configuration of the rocker arm mounting results from the radial and the axial roller bearing being constructed as a one-piece assembly in the form of a combined radial-axial roller bearing. This compact assembly diminished the overall expenditure in assembling the rocker arm arrangement.

An especially advantageous embodiment of this combined radial-axial roller bearing provides the outer ring as well as the inner ring of the bearing being formed in a chipless process, which each have on their exterior sides a radially outwardly directed flange that acts as a thrust washer which serves as a raceway for the rolling element of the axial roller bearing.

Finally, a further additional feature provides that the outer bearing ring of the radial roller bearing has a radially inwardly directed rim, and the radially outwardly directed flange of the axial roller bearing has an axially oriented collar. In this way, it is assured that even in a cageless application, the rolling elements of the radial bearing as well as the rolling elements of the axial bearing cannot leave the combined bearing assembly.

BRIEF DESCRIPTION OF THE DRAWINGS

The invention will be explained below with reference to a preferred embodiment. In the drawings.

DETAILED DESCRIPTION OF THE PREFERRED EMBODIMENT

Figure 1:
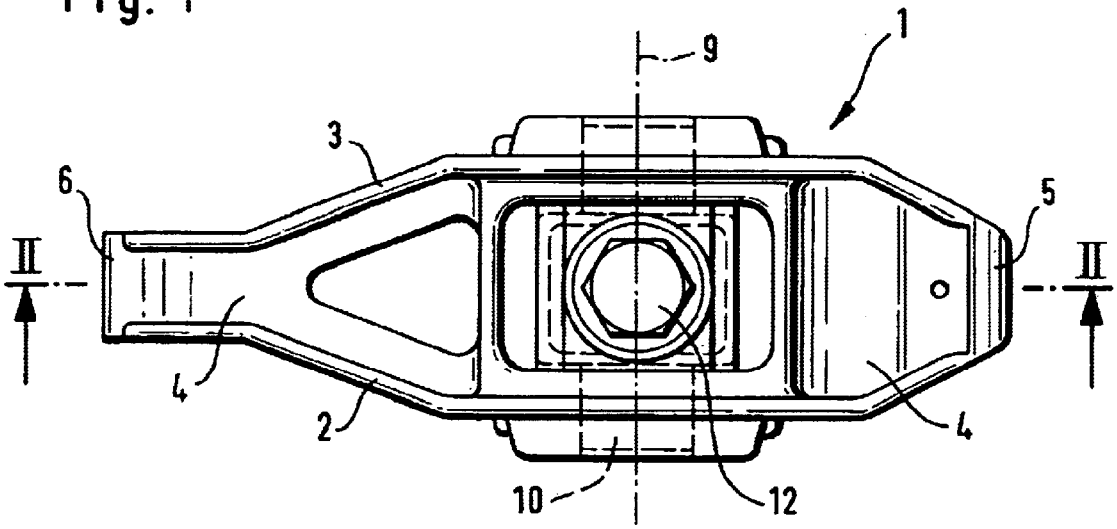
FIG. 1 is a plan view of a rocker arm arrangement according to the known state of the art.
Figure 2:
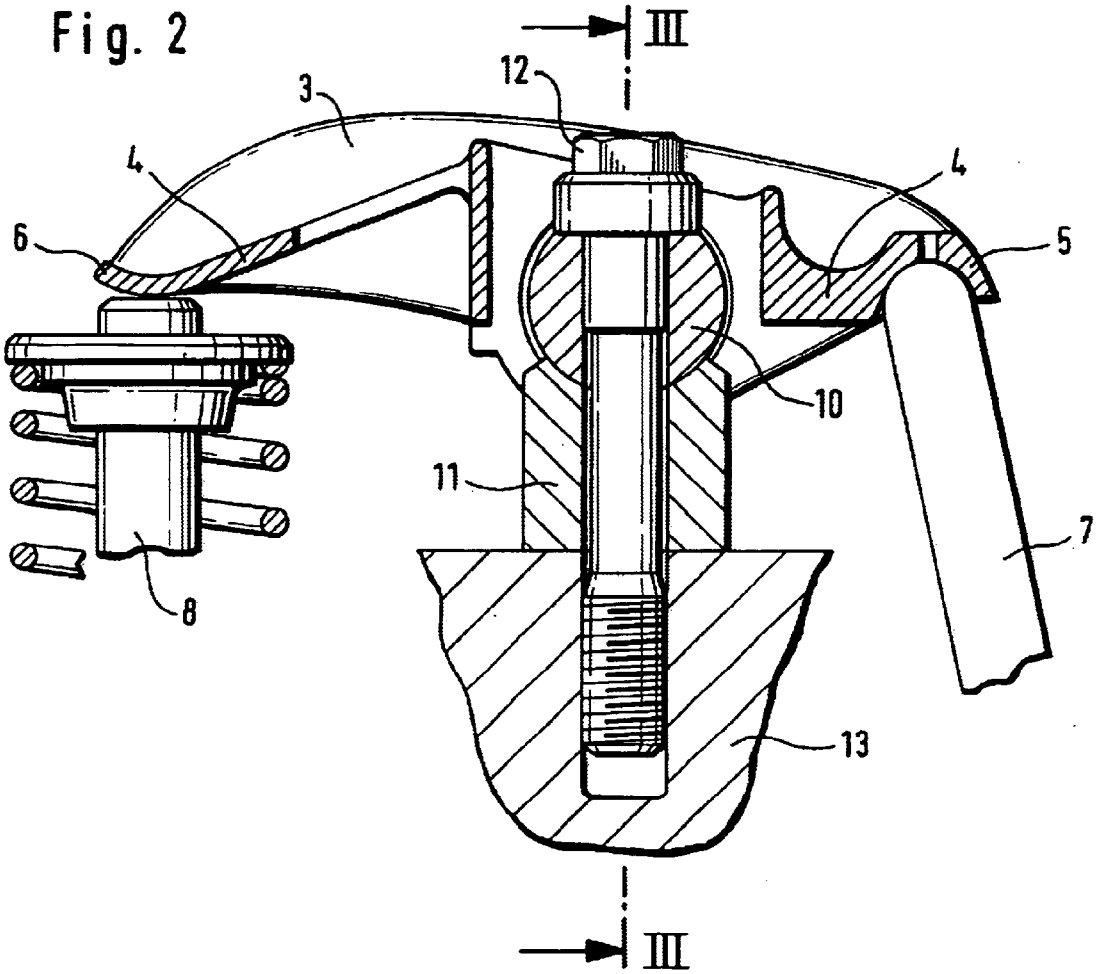
FIG. 2 is a longitudinal section taken along line II—II in FIG. 1.
Figure 3:
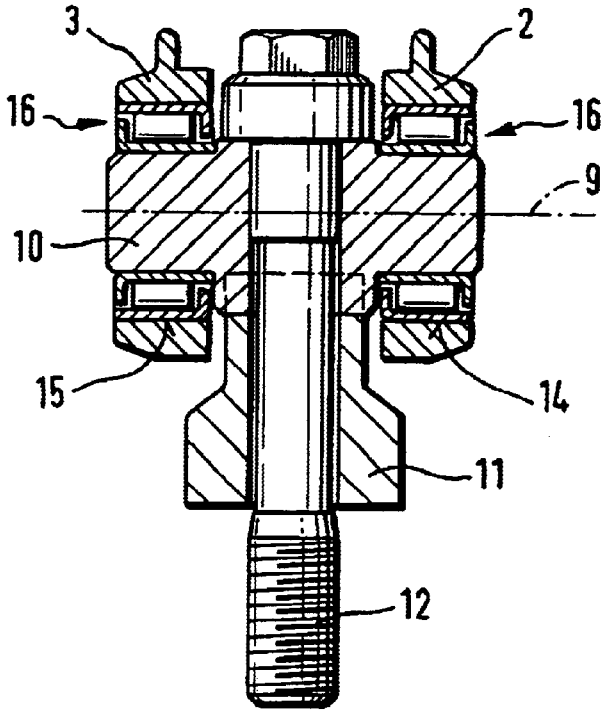
FIG. 3 is a cross-section along line III—III in FIG. 2.

The rocker arm 1 represented in FIGS. 1, 2 and 3 according to the state of the art is basically constructed with a U-shape that is open toward the top and includes two side walls 2, 3 which are connected with each other by a lower wall 4. The side walls 2, 3 extend parallel to each other in the central part of the rocker arm 1, while they extend towards each other in both opposite-lying outer regions. In this way, two end sections 5, 6 of diminished breadth are formed. One end section contacts a push rod 7 and the other end section contacts a valve shaft 8 of a gas exchange valve. If a motion of the push rod 7 is triggered by a cam (not depicted), then the rocker arm 1 executes a pivoting motion about its axis 9, so that as the right side end section 5 moves upward, the left side end section 6 moves downward to open the valve.

Figure 3A:
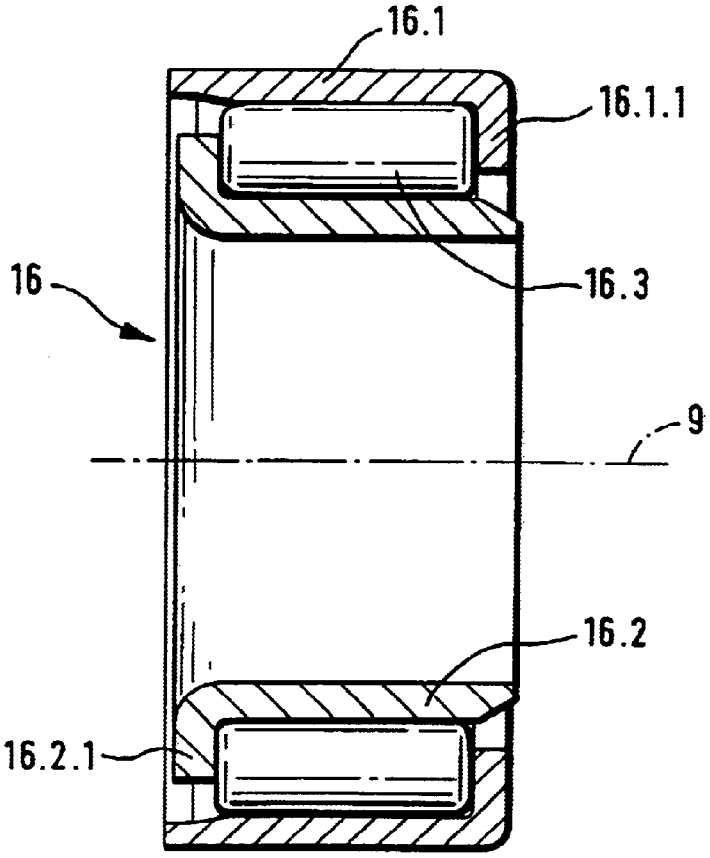
FIG. 3*a* is an enlarged representation of the radial bearing in FIG. 3, FIGS. 4 and 5 are enlarged cross-sectional views through a rocker arm arrangement of the invention.

As further shown in the above-mentioned figures, the rocker arm 1 is held on a support pin 10 which is connected with the cylinder head 13 via the support block 11 and a fastening bolt 12 that penetrates both. The rocker arm 1 is slid onto the support pin 10 through its two side walls 2, 3 which have aligned holes 14, 15. The pivoting motion fixation of the rocker arm 1 about its axis 9 takes place through radial roller bearings 16 mounted on each of the right and left sides of the fastening bolt 12 in the aligned holes 14, 15 of the side walls 2, 3. The radial roller bearing 16, shown in an enlarged view in FIG. 3*a*, includes an outer bearing ring 16.1 and an inner bearing ring 16.2 which both are provided at one end with a rim pointing radially inward or radially outwardly. Between both bearing rings 16.1 and 16.2, rolling elements 16.3 roll on raceways, in the present case without a cage, but which can also be guided by a cage.

Figure 4:
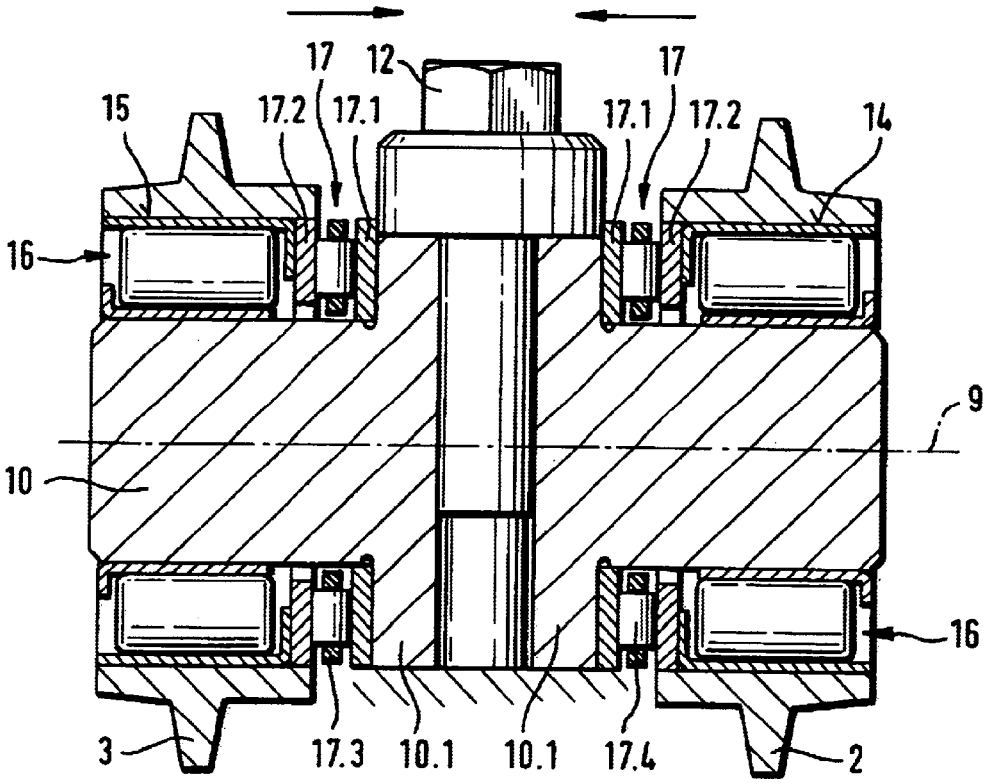

The rocker arm bearing arrangement shown according to the invention in FIG. 4 likewise includes the two radial roller bearings 16, which are inserted on the right and left sides of the fastening bolt 12 into the aligned holes 14, 15 of the side walls 2, 3. Axially adjacent to each of the radial roller bearings 16, a corresponding axial roller bearing 17 is provided which includes two thrust washers 17.1 and 17.2 between which rolling elements 17.4 roll guided on respective raceways in a cage 17.3. The outer thrust washer 17.2 is inserted with its outer diameter into hole 14 or 15, while the inner thrust washer 17.1 is located with its inner opening placed on the support pin 10 and lies on its shoulder 10.1. If the rocker arm 1 is now acted upon through the push rod 7 with an axial inwardly directed force as represented by the two arrows, then the two axial roller bearings 17 arranged according to the invention prevent sliding friction between the adjacent contact surfaces involved.

Figure 5:
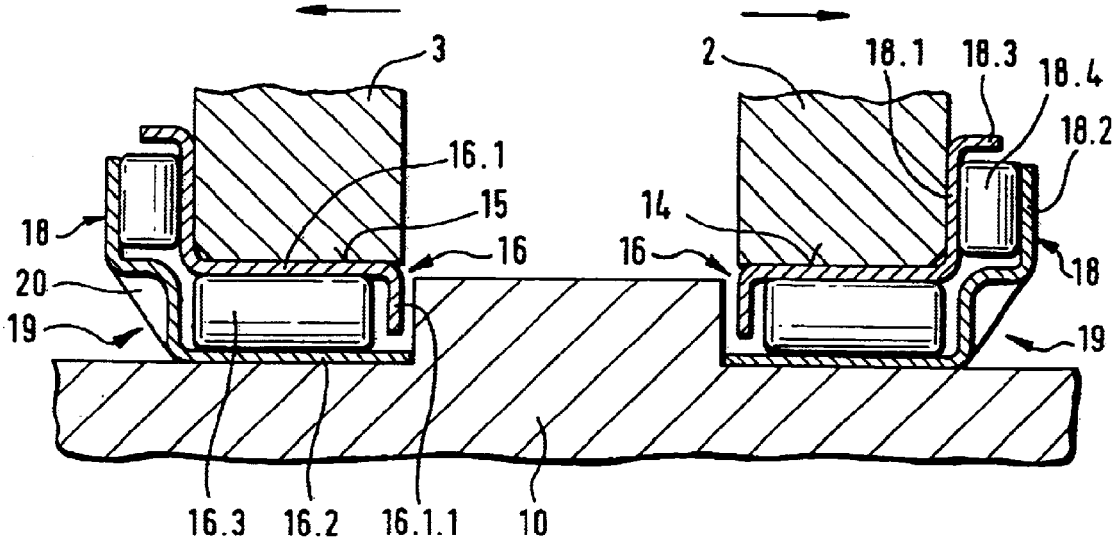

The rocker arm bearing of the invention shown in FIG. 5 once again includes the two radial roller bearings 16 located in aligned holes 14, 15 of the side wall 2, 3. The chiplessly shaped outer bearing ring 16.1 as well as the chiplessly shaped inner bearing ring 16.2 each have a flange directed radially outwardly, which are spaced apart from each other in an axial direction and form thrust washers 18.1, 18.2 of an axial roller bearing. Because the outer bearing ring 16.1 of the radial roller bearing 16 is provided with the radially inwardly pointing rim 16.1.1, and the thrust washers 18.1 of the axial bearing 18 is provided with the axially oriented collar 18.3, a combined radial-axial roller bearing assembly including the radial roller bearing 16 and axial roller bearing 18 is formed, the rolling elements 16.3, 18.4 of which are held therein secure from loss. It has proven advantageous if reinforcements 20 are present in the transition region between radial roller bearing 16 and axial roller bearing 18 for improving stability.

| Reference numbers | |
|---|---|
| 1 | Rocker arm |
| 2 | Side wall |
| 3 | Side wall |
| 4 | Lower wall |
| 5 | End section |
| 6 | End section |
| 7 | Push rod |
| 8 | Valve shaft |
| 9 | Axis |
| 10 | Support pin |
| 10.1 | Shoulder |
| 11 | Support block |
| 12 | Fastening bolt |
| 13 | Cylinder head |
| 14 | Hole |
| 15 | Hole |
| 16 | Radial roller bearing |
| 16.1 | Outer bearing ring |
| 16.2 | Inner bearing ring |
| 16.1.1 | Rim |
| 16.1.1 | Rim |
| 16.3 | Rolling element |
| 17 | Axial roller bearing |
| 17.1 | Thrust washer |
| 17.2 | Thrust washer |
| 17.3 | Cage |
| 17.4 | Rolling element |
| 18 | Axial roller bearing |
| 18.1 | Thrust washer |
| 18.2 | Thrust washer |
| 18.3 | Collar |
| 18.4 | Rolling element |
| 19 | Radial-axial roller bearing |
| 20 | Reinforcement |

What is claimed is:

1. Rocker arm for a valve drive of an internal combustion engine which is pivoted through a bearing arrangement on a support pin, whereby the support pin is connected with a cylinder head through a support block, the rocker arm comprising a U-shaped metal element with at least two side walls that extend generally parallel to one another in a region of the support pin and have aligned holes, in each of which a radial roller bearing is located, an outer bearing ring of each of the radial roller bearings is arranged in a respective one of the holes, the side walls are connected to each other through at least one of an upper and a lower wall so that a valve shaft of a gas exchange valve contacts one end section of the rocker arm, and an axial roller bearing is arranged in connection with at least one of the radial roller bearings accommodated in the holes.

2. Rocker arm according to claim 1, wherein the axial roller bearing is arranged inside or outside in connection with at least one of the radial roller bearings.

3. Rocker arm according to claim 1, wherein the radial roller bearing comprises two bearing rings manufactured in a chipless process which have on each opposite-lying end a radially inwardly directed and a radially outwardly directed rim, respectively, and the axial roller bearing comprises two thrust washers between which rolling elements roll guided in a cage, whereby one thrust washer is braced upon the radially inwardly directed rim and the other thrust washer is braced on a shoulder of the support pin.

4. Rocker arm according to claim 1, wherein the radial roller bearing and axial roller bearing are constructed as a one-piece assembly in the form of a combined radial-axial roller bearing.

5. Rocker arm according to claim 4, wherein the outer bearing ring is shaped in a chipless process, the inner bearing ring is shaped in a chipless process and includes one flange oriented radially outwardly acting as a thrust washer on an exterior thereof which serves as a raceway for the rolling elements of the axial roller bearing.

6. Rocker arm according to claim 4, wherein the outer bearing ring of the radial roller bearing has a radially inwardly directed rim and the axial roller bearing has a radially outwardly oriented flange with an axially directed collar.

7. Rocker arm according to claim 1, wherein the radial roller bearing comprises two bearing rings manufactured in a chipless process which have on each opposite-lying end a radially inwardly directed and a radially outwardly directed rim, respectively, and the axial roller bearing comprises two thrust surfaces formed by the rim and a shoulder of the support pin between which rolling elements roll guided in a cage.

* * * * *